United States Patent [19]

Payne

[11] 3,967,735

[45] July 6, 1976

[54] CRANES WITH LOOK INDEPENDENT OF SHEAVE BLOCK

[76] Inventor: Alexander William Payne, 2, Appleshaw Close, Harestock, Winchester, England

[22] Filed: Jan. 28, 1975

[21] Appl. No.: 544,793

[30] Foreign Application Priority Data

Jan. 28, 1974 United Kingdom ..... 3873/74
Feb. 14, 1974 United Kingdom ..... 6817/74

[52] U.S. Cl. ..... 212/3; 254/194
[51] Int. Cl.[2] ..... B66C 23/52
[58] Field of Search ..... 294/82 R, 83 R; 212/1, 212/9, 3, 58 R, 59 R, 8 R; 254/194, 195, 196

[56] References Cited

UNITED STATES PATENTS

| | | | |
|---|---|---|---|
| 816,698 | 4/1906 | Yentzer | 212/100 |
| 2,973,942 | 3/1961 | Schaper | 254/195 |
| 3,193,116 | 7/1965 | Kenneday et al. | 254/139 |
| 3,306,469 | 2/1967 | Durand | 212/100 |
| 3,365,075 | 1/1968 | Gils et al. | 212/3 R |

*Primary Examiner*—Frank E. Werner
*Assistant Examiner*—Lawrence J. Oresky
*Attorney, Agent, or Firm*—Holman & Stern

[57] ABSTRACT

A crane is provided with a sheave-block, a winch for lifting and lowering the sheave-block, a crane hook, spring-loaded catches for demountably attaching the crane hook to the sheave-block, and a tension-imparting winch unit for lifting and lowering the crane hook independently of the sheave-block the tension-imparting winch unit being provided with an "over-riding" device whereby tension on the winch cable is removed.

5 Claims, 2 Drawing Figures

CRANES WITH LOOK INDEPENDENT OF SHEAVE BLOCK

BACKGROUND TO THE INVENTION

This invention relates to cranes. As used herein, the term "crane" is intended to include like lifting machines, such as hoists.

Furthermore, as used herein, the term "crane hook" is intended to include like load-suspension devices, such as shackles.

A problem exists where cranes operate in unstable environmental conditions. For example, where the crane is rising and falling relative to the load to be handled by the crane, as occurs where the crane is mounted on an off-shore oil rig and the load is carried on a vessel disposed alongside the rig. Another example occurs when the load to be lifted is again carried by a vessel but in this case the crane (which may now be in the form of a hoist) is mounted on a fixed or rotary wing aircraft.

The problem stems from the need to lower the crane hook (or the like) carefully to a position adjacent the load and then to attach the hook to the load by way of slings, strops or the like, already placed in position. This operation has to be carried out quickly and at an opportune moment, before relative movement between the load and the crane makes attachment to the hook impossible or dangerous.

It will be appreciated that the moment of attachment must be judged precisely; the time available for attachment may be very limited and once attachment is made, the load must be lifted immediately. Furthermore, it will be appreciated that personnel making the attachment may have little or no time to stand clear.

Successful operations are therefore achieved only by the skill of the personnel employed, but, nevertheless, they are potentially unsafe.

SUMMARY OF THE INVENTION

According to the invention, a crane is provided with a sheaveblock, means for lifting and lowering the sheave-block, a crane hook, means for demountably attaching the crane hook to the sheave-block, and means for lifting and lowering the crane hook independently of the sheave-block.

The means for lifting and lowering the crane hook preferably comprise a support cable and means capable of biasing the support cable towards the sheave-block.

The means for demountably attaching the crane hook to the sheave-block preferably operates in an automatic manner.

BRIEF DESCRIPTION OF THE DRAWINGS

An embodiment of the invention will now be described by way of example with reference to the accompanying drawings, wherein.

DETAILED DESCRIPTION OF THE INVENTION

Figure 1:
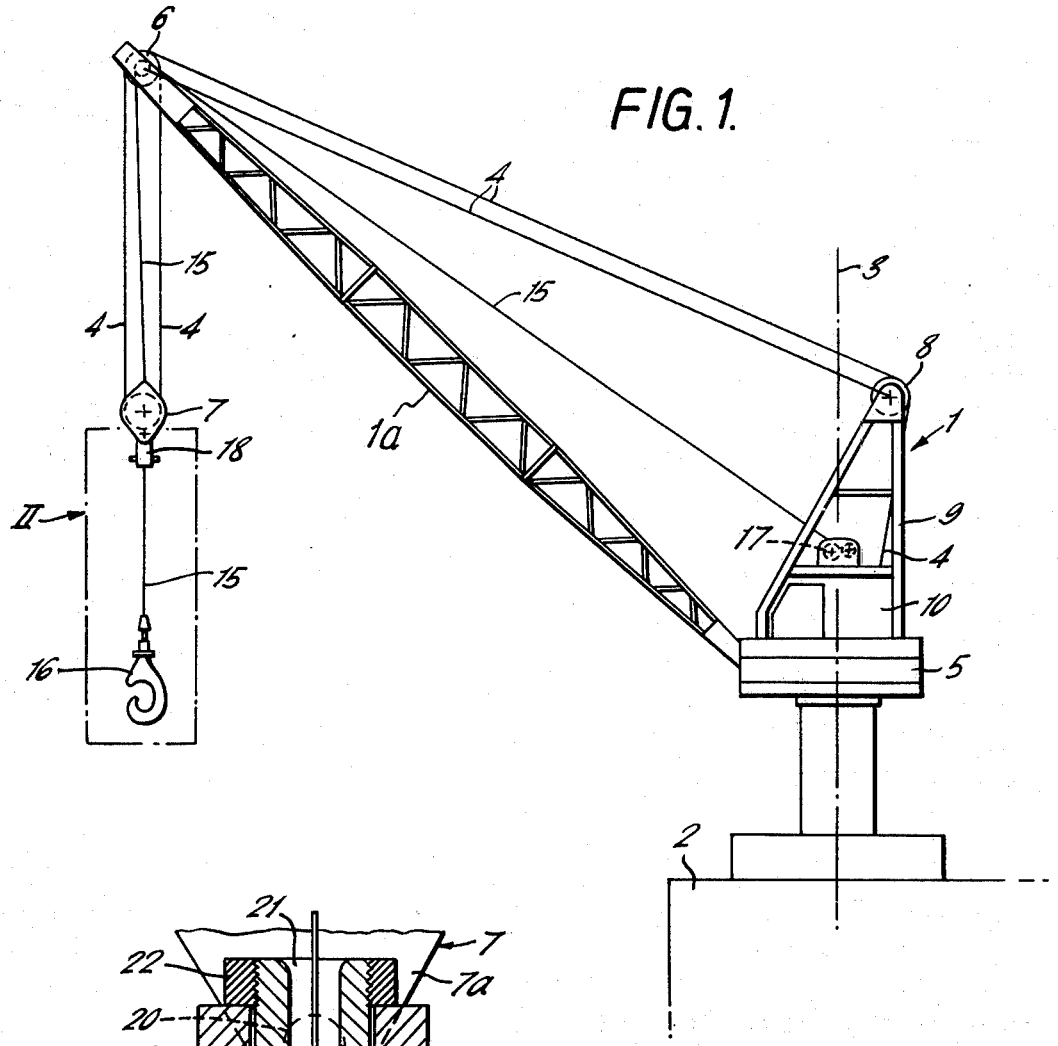
FIG. 1 is a side view of a crane.

With reference to the figures, a jib crane 1 is shown mounted on an off-shore oil rig 2. The crane 1 is rotatable about a substantially vertical axis 3 and is provided with a luffing jib 1*a*. The lower end of the jib 1*a* is pivotally attached to the body 5 of the crane. The other end of the jib 1*a* carries rotatably mounted pulleys 6. A multisheave lifting block 7 is suspended by cables 4 which extend over the pulleys 6 and further pulleys 8 carried by a support frame 9 mounted on the crane body 5, and are connected to a winch unit 10 also mounted on the crane body 5. The winch unit 10 and primary cables 4 comprise means for lifting and lowering the sheave-block 7.

Figure 2:
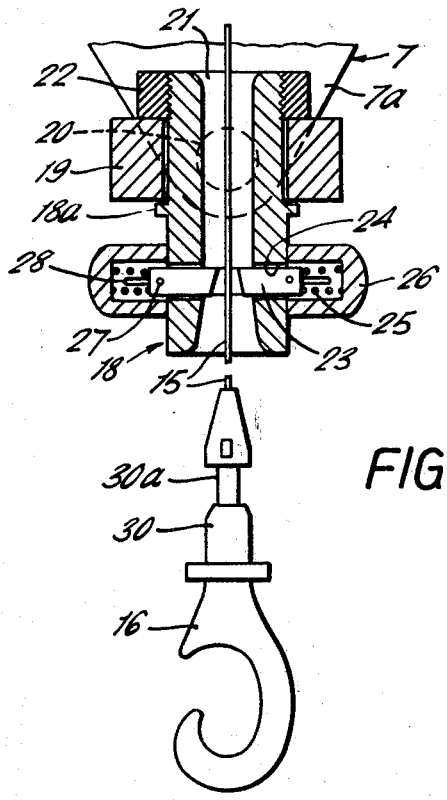
FIG. 2 is an enlarged view, partly in medial section, of the components enclosed by the box II of FIG. 1.

With particular reference to FIG. 2, the sheave-block 7 comprises a pair of side plates 7*a* (only one shown). The sheaves (not shown) are rotatably mounted between the side plates 7*a* by means of a pair of journal pins. A space is provided between adjacent (inner) ends of the journal pins, and this space allows free passage of a secondary cable 15 connected to and extending between a crane hook 16 and a special winch unit 17 mounted on the crane body 5. Thus the crane hook 16 can be supported, lifted and lowered independently of the sheave-block 7.

A sleeve 18 is disposed between the lower ends of side plates 7*a* and is pivotally attached thereto by a load-carrying cross-head 19 mounted on a pivot pin 20 extending between the plates. The cable 15 extends, with substantial clearance, through the bore 21 of the sleeve 18. The cross-head 19 is located between a load-bearing flange 18*a* (forming part of the sleeve 18), and a load-bearing ring 22 screwed on to the upper end of the sleeve.

Catch members 23 are located by oppositely-disposed guide slots 24 formed in the lower part of the sleeve 18. The catches, which have outwardly-tapered inner ends, are urged towards each other, i.e. towards the centre of the sleeve bore 21, by compression springs 25 carried in housings 26 attached to the sleeve 18. The catches 23 carry laterally-extending pins 27 which are slideably located in slots 28 formed in the housings 26. As will be appreciated from description below, the catches 23 comprise means for demountably attaching the crane hook 16 to the sheave-block 7.

The special winch unit 17 automatically tensions the secondary cable 15. It incorporates a cable drum driven by an electric motor through a gear train and a load-pull limiting device. (These components are not shown). The output torque of the tension-imparting unit is variable and can be governed whereby it tends to bias the support secondary cable 15 upwardly, towards the sheave-block 7, unless the crane hook 16 is pulled down by a force in excess of that so biasing the secondary cable 15. The unit 17 is also provided with an "over-riding" device so that it can also be made to lower the hook 16 without the need for pulling down the latter, thereby allowing the hook 16 to be lowered independently of the sheave-block 7.

The upper portion of the crane hook 16 forms a shank 30 provided with a reduced or "necked" portion 30*a*. The upper end of the shank 30 is tapered to allow easy entry of the shank into the sleeve bore 21 where it is located with sliding clearance. As the shank 30 enters the bore 21, the catches 23 are forced apart, against the springs 25, until the "necked" portion 30*a* of the shank is opposite the catches. The catches can then move inwardly, under the influence of the springs 25, so that the catches engage with the shank. This locks the sleeve 18 (and thereby the sheave 7) and the crane hook 16 together.

In operation, the hook 16 is first released from the sleeve 18 by pulling back the pins 27 so as to free the catches 23 from the necked portion 30*a* of the shank. The hook 16 is then pulled down, against the torque exerted by the unit 17, until the hook is well clear of the sleeve 18, as shown. (Alternatively, the hook 16 may be lowered by the unit 17).

The hook 16 and sheave 7 are then lowered towards the load (not shown) to be lifted. The hook 16 can be pulled lower if necessary, and then made fast to the load. Since the secondary cable 15 is tensioned by the unit 17, the hook 16 can rise and fall should the load rise and fall relative to the crane 1.

The hook is now automatically re-connected to the sleeve 18 by lowering the sleeve until the shank 30 of the hook is re-engaged by the catches 23. With the hook 16 and sheave-block 7 locked together the load can be lifted onto the oil rig 2 by the winch unit 10 through primary cable 4 whilst the secondary cable 15 is kept tensioned by the unit 17.

To disconnect the load when it is on the oil ring 2, it is necessary to pull back the catches 23, and lift the sleeve 18 clear of the hook 16 before disconnecting the hook by pulling or lowering down the secondary cable 15. As re-connection of the hook 16 to the block 7 is made automatically, the operatives can stand well clear as the load is lifted.

Use of the invention thus allows lifting operations to be carried out in conditions which previously have been considered unwise or unsafe.

It will be appreciated by those skilled in the art that many modifications can be made to the embodiment described and illustrated. For example, some other method of demountably attaching the hook 16 to the sheave-block 7 could be used. All that is necessary is that detachment of the hook to the load can be made without having to move the hook and the sheave-block in toto. An electro-mechanical arrangement using solenoid-operated catches could be used.

The cable-tensioning unit 17 may use a mechanical, electrical, hydraulic or pneumatic motor, and a slipping mechanism may also be used.

A suitable cable-tensioning unit is employed for applying an adjustable tension to aerial wires extending between pylons, or, (in an enlarged form), for applying tension to the mooring cables of ships etc.

I claim:

1. In a crane, comprising, in combination:

sheave block means;

primary cable means operatively-connected to said sheave block means;

winch means operatively-connected to said primary cable means for raising and lowering the sheave block means and a load suspended therefrom;

crane hook means for engaging a load to be raised or lowered;

secondary cable means connected directly to said crane hook for raising the crane hook means completely independent relative to said sheave block means;

second winch means operatively-connected to said crane hook means for moving the crane hook means relative to the sheave block means and to a load; and cooperating means between said sheave block means and said crane hook means for detachably connecting the crane hook means and the sheave block means.

2. The structure as claimed in claim 1 in which said cooperating means for detachably connecting the crane hook means and sheave block means comprises at least one spring-loaded catch member.

3. The structure as claimed in claim 1 in which said cooperating means for detachably connecting the crane hook means and sheave block means comprises a sleeve portion depending from said sheave block means and through which said secondary cable means is payed, said crane hook means including a portion telescopically received in said sleeve portion, and spring-loaded catch members between said sleeve portion and crane hook means portion.

4. The structure as claimed in claim 3 in which said crane hook means portion comprises a reduced cross-section neck portion, said sleeve portion including at least one displacable, spring-loaded, catch member engageable within said reduced cross-section neck portion.

5. The structure as claimed in claim 1 in which said sheave block means comprises a pair of spaced plates, said cooperating means comprising a sleeve member connected between and depending below said plates, said secondary cable means being payed through said sleeve member, said hook means including an upper neck portion telescopically received in the lower end of said sleeve member, and at least one spring-urged catch-member on at least one of said sleeve member and neck portion for detachably connecting the hook means and sheave means.

* * * * *

UNITED STATES PATENT AND TRADEMARK OFFICE

CERTIFICATE OF CORRECTION

PATENT NO. : 3,967,735

DATED : July 6, 1976

INVENTOR(S) : Alexander William Payne

It is certified that error appears in the above-identified patent and that said Letters Patent are hereby corrected as shown below:

[54] Title:

CRANES WITH HOOK INDEPENDENT OF SHEAVE BLOCK

Signed and Sealed this

Twenty-first Day of September 1976

[SEAL]

*Attest:*

RUTH C. MASON
*Attesting Officer*

C. MARSHALL DANN
*Commissioner of Patents and Trademarks*